US010132462B2

(12) United States Patent
Moser et al.

(10) Patent No.: US 10,132,462 B2
(45) Date of Patent: Nov. 20, 2018

(54) OPTICAL STRUCTURE HAVING A MICROSTRUCTURE WITH A QUADRATIC DIFFUSION FUNCTION

(71) Applicant: ZIZALA LICHTSYSTEME GMBH, Wieselburg (AT)

(72) Inventors: Andreas Moser, Haag (AT); Dietmar Kieslinger, Theresienfeld (AT); Josef Pürstinger, Wieselburg (AT)

(73) Assignee: ZKW GROUP GMBH, Wieselburg an Der (AT)

( * ) Notice: Subject to any disclaimer, the term of this patent is extended or adjusted under 35 U.S.C. 154(b) by 364 days.

(21) Appl. No.: 14/916,499

(22) PCT Filed: Aug. 28, 2014

(86) PCT No.: PCT/AT2014/050190

§ 371 (c)(1),
(2) Date: Mar. 3, 2016

(87) PCT Pub. No.: WO2015/031925

PCT Pub. Date: Mar. 12, 2015

(65) Prior Publication Data

US 2016/0201867 A1 Jul. 14, 2016

(30) Foreign Application Priority Data

Sep. 3, 2013 (AT) ..... A50543/2013

(51) Int. Cl.
*F21V 1/00* (2006.01)
*F21S 8/10* (2006.01)
(Continued)

(52) U.S. Cl.
CPC ..... *F21S 48/1283* (2013.01); *F21S 41/255* (2018.01); *F21S 41/275* (2018.01); *F21S 41/43* (2018.01)

(58) Field of Classification Search
None
See application file for complete search history.

(56) References Cited

U.S. PATENT DOCUMENTS 1,370,885 A 3/1921 Frederick et al.
5,836,674 A 11/1998 Nishitani et al.
(Continued)

FOREIGN PATENT DOCUMENTS

DE 102007063569 A1 7/2009
DE 102008023551 A1 11/2009
(Continued)

OTHER PUBLICATIONS

First Office Action for Austrian Patent Application No. A 50543/2013 dated Jul. 18, 2014.
(Continued)

*Primary Examiner* — Elmito Breval
(74) *Attorney, Agent, or Firm* — Eversheds Sutherland (US) LLP

(57) ABSTRACT

The invention relates to an optical structure (100) for a motor vehicle headlight lighting device (1) that is set up to emit light forming a specified light pattern (LP1), wherein the optical structure (100) of the lighting device (1) is associated with the lighting device (1), or is part of it in such a way, that the optical structure (100) is transilluminated by essentially the entire luminous flux of the lighting device (1), and wherein the optical structure (100) consists of a number of optical structural elements (110) that have a light-scattering effect and that are designed in such a way that the unmodified light pattern (LP1) produced by the lighting device (1) is modified by the optical structure (100) into a specifiable modified light pattern (LP2), and wherein the optical structural elements (110) have a quadrilateral base area (202), i.e., the area (202) between the vertices (201) of
(Continued)

Figure 1:
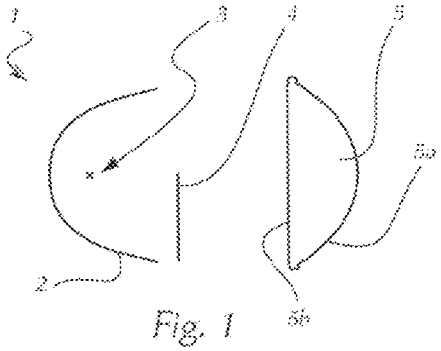

a quadrilateral grid (200) is completely covered by the base area of exactly one optical structural element (110).

67 Claims, 10 Drawing Sheets

(51) Int. Cl.
*F21S 41/255* (2018.01)
*F21S 41/275* (2018.01)
*F21S 41/43* (2018.01)

(56) References Cited

U.S. PATENT DOCUMENTS 5,995,303 A * 11/1999 Honguh ..... G02B 5/1876 359/237
7,988,328 B2 * 8/2011 Cheng ..... F21V 5/04 362/237
2010/0284197 A1 11/2010 Kiesel
2014/0003079 A1 1/2014 de Lamberterie et al.
2014/0334177 A1 * 11/2014 de Lamberterie .. F21S 48/1283 362/522

FOREIGN PATENT DOCUMENTS

DE 102012018517 A1 3/2013
EP 2306074 A2 4/2011
EP 2587125 A2 5/2013

OTHER PUBLICATIONS

International Search Report for PCT/AT2014/050190 dated Jan. 27, 2015.
IPRP for PCT/AT2014/050190 dated Jan. 27, 2015.

* cited by examiner

OPTICAL STRUCTURE HAVING A MICROSTRUCTURE WITH A QUADRATIC DIFFUSION FUNCTION

The invention relates to an optical structure for a motor vehicle headlight lighting device that is set up to emit light forming a specified light pattern.

The invention also relates to a vehicle headlight device having such an optical structure.

The invention also relates to a vehicle headlight with at least one such a lighting device.

Legal provisions place a series of requirements on the light patterns of vehicle headlights.

For example, ECE and SAE require minimum and maximum light intensities in certain regions above the light/dark line (LD line), that is outside the primarily illuminated area. These function as "sign light" and allow overhead road signs to be illuminated by passing vehicles. The light intensities used usually lie over the usual scattered light values, but far below the light intensities below the LD line. The required light values must be achieved with as little blinding as possible.

"Sign light" is usually realized by special facets in the projector lens (of at least a few millimeters in size), or by discrete, small elevations. The disadvantage of this is, in particular, that these structures can be perceived from outside as bright light points, and thus are increasingly rejected, above all for design reasons. In addition, such devices are tailored to the optical system behind them if changes are made in it, the sought-after function is no longer guaranteed.

Furthermore, for legal reasons it is necessary to define fuzzy light/dark boundaries so that projected LD lines are neither too sharp nor too blurred, i.e., the maximum sharpness of the LD line is legally defined. Such blurring of the LD line makes the driver perceive the LD line as "softer" and subjectively more pleasant.

This LD transition is quantified by the maximum of a gradient along a vertical section through the light/dark boundary. To do this, the logarithm of the illuminance is calculated at measurement points separated by 0.1°, and their difference is taken, producing the gradient function. The maximum of this function is designated as the gradient of the LD boundary. Since this definition only roughly models human perception of brightness, differently perceived LD lines can have the same measured gradient value, or different gradients can be measured for LD lines of similar appearance.

The gradient is usually softened by changing the surface of a lens of a lighting device. Various prior art solutions are common: A softer LD boundary can be achieved, for example, by statistical roughening of the lens surface, however this blinds oncoming road users. In other variants, a modulation (e.g., superimposition of two sine waves, small depressions in the form of spherical segments, etc.) is applied to the lens surface. Such solutions are strongly dependent on the distribution of luminous flux through the lens, so changes in it due to variation of the illuminating engineering, for example, then have a strong and sometimes negative effect on the luminous flux distribution that is produced.

The production of segmented light patterns is another subject. Segmented light patterns are used, for example, to produce dynamic light patterns, for instance a dynamic high beam pattern. In special embodiments, such a dynamic light pattern is built from a number of individual light patterns. This is accomplished, for example, with individual light sources, each of which is associated with an optical attachment and each of which produces a small segment in the light pattern, and these light segments are then superimposed to produce the entire light pattern. Turning off individual light sources can turn off, that is not illuminate, individual segments in the light pattern. These segments are usually arranged in rows and columns.

In theory, it is possible for the individual light segments to be projected with sharp boundary edges, and to take measures to ensure that adjacent light segments directly border on one another. This has the advantage that in "full light" operation, i.e., when all light segments are activated, no dark areas ("grid") can be seen between the light segments. However, this has the disadvantage that when one or more light segments is/are turned off the light pattern in these areas has a sharp light/dark boundary, which is perceived to be unpleasant, and additionally quickly leads to fatigue.

Another approach is not to let the light segments border one another directly. Such light patterns have turned out to have the problem that there are naturally unwanted light effects in the area of the bordering segments, in particular there are fluctuations in brightness in this area that manifest themselves in a visible grid structure that can be perceived as unpleasant by a vehicle driver.

Moreover, even in this case there is still, as a rule, the problem of the sharp light/dark boundary.

The described disadvantages of the prior art should be eliminated. Therefore, it is a goal of the invention to provide a refractive optical component with which it is possible to realize a light pattern that meets the legal values and simultaneously is not perceived as annoying.

This goal is achieved with an inventive optical structure mentioned at the beginning by the fact that the optical structure of the lighting device is associated with the lighting device, or is part of it in such a way, that the optical structure is transilluminated by essentially the entire luminous flux of the lighting device, and by the fact that the optical structure consists of a number of optical structural elements that have a light-scattering effect and that are designed in such a way that the unmodified light pattern produced by the lighting device is modified by the optical structure into a specifiable modified light pattern, and by the fact that the optical structural elements have a quadrilateral base area, i.e., that the area between the vertices of a quadrilateral grid is completely covered by the base area of exactly one optical structural element.

The quadrilateral base area of the optical structural elements is delimited by straight sides, i.e., each pair of adjacent vertices of the base area of an optical structural element is connected with a straight side. However, this statement relates to a "planar" grid, as is briefly explained below:

Usually it can be assumed that the optical structure is applied onto an basic optical structure, i.e., starting from an unmodified surface, for example a smooth, planar cover plate or a lens surface, for example the planar light entrance surface or also the curved light exit surface. In a planar basic structure the grid is a planar, two-dimensional grid, in which the structural elements are arranged with their planar, quadrilateral base areas.

In the case of a curved surface, it is assumed, for calculation of the structural elements and for their arrangement, that the surface is planar, that is a planar grid, and the structural elements have a planar quadrilateral base area with straight sides. This planar grid is then projected onto the curved surface of the basic structure, so that in this case the "actual" grid is no longer planar and the base areas of the structural elements on the curved basic structure are also no longer planar but rather curved, and the four sides delimiting the base area are also curved.

In practice, this distinction is of little significance, since the optical structural elements are so small that in the area of a structural element the curved surface can be assumed to be planar.

Thus, if a quadrilateral, etc., with straight sides is being discussed in connection with a curved basic structure, this should be understood to mean the projection of this curved surface into a plane.

Thus, the above-described "planar" surface has a two-dimensional grid stretched over it, wherein each 4 grid points form a grid cell. Such a grid cell is occupied by an optical structural element. This "base area" corresponds to the surface of the planar grid cell, the optical structural element itself has this quadrilateral base area, and the actual surface of the structural element has a positive or negative distance (or possibly also in areas a zero distance) to this base area.

The essence of the invention is that the fact that the grid is quadrilateral and the base area of the structural element occupies the entire surface of a grid cell allows the entire surface of the "basic structure" to be used for modification of the light pattern. A hexagonal grid with circular structural elements, which also fills about 90% of the area with the structural elements, which is already a very high proportion, still leaves a small proportion of about 10% of the base area unmodified, so it does not contribute to modifying the light pattern.

A parallel patent application of the applicant describes an optical structure mentioned at the beginning that is formed of optical structural elements which have a circular base and are arranged in a hexagonal grid. In such a hexagonal arrangement, about 91% of the curved boundary lens surface can be covered with structural elements, but about 9% of the lens surface remains uncovered. When such a lens is used to project sharply delimited light segments, e.g., rectangular light segments, these uncovered areas of the lens surface cause the light segments to have sharp edges, and thus produce inhomogeneities in the light pattern.

This arrangement, in which the lens surface is 100% covered with the structural elements, makes it possible to produce a homogeneous light pattern, even with sharply delimited light segments that the lens projects in an area in front of the vehicle.

The quadrilateral shape of the base area of the structural elements, whose symmetry preferably corresponds to that of the light segments, additionally allows optimal illumination of the vertex areas between four light segments, which is impossible with structural elements having a circular base.

A preferred embodiment of the invention provides that the modified light pattern is formed by convolution of the unmodified light pattern with a spread function, and that the optical structure is designed in such a way that the unmodified light pattern is modified according to the spread function.

Thus, the invention provides that the entire optical structure is viewed and is correspondingly modified or shaped through a spread function in such a way to produce the complete desired light pattern. In contrast to the prior art, which, for example, produces the gradient softening and sign light by using different structural elements on an optical structure or by additionally modifying some of the existing structural elements, this invention realizes the desired (modified) light pattern from an unmodified light pattern produced by the lighting device without an optical structure, by convolution of the unmodified light pattern with a spread function that produces the desired light pattern, and then forming the entire optical structure so that it modifies the entire luminous flux of the lighting device so that a modified light pattern corresponding to the spread function results from the unmodified light pattern.

Preferably, this involves distributing the structural elements over at least one, preferably exactly one, defined surface of at least one, preferably exactly one optical element.

It is especially advantageous for the optical structural elements to be designed in such a way that every structural element modifies the light beam passing through the structural element according to the spread function to produce a modified tight beam.

If we consider a certain (unmodified) light beam from the entire luminous flux, this light beam makes a certain contribution to the light distribution in the light pattern (the entire luminous flux produces the (entire) light pattern). A structural element now modifies a light beam passing through the structural element in such a way that the unmodified contribution to the entire light pattern is changed according to the spread function. For example, the unmodified light beam contributes to a light pattern with a certain shape, i.e., certain areas on the road or on a plotting screen are illuminated, and other areas are not illuminated. The structural element now also illuminates areas outside the originally illuminated area with a certain intensity according to the spread function, while—since the entire luminous flux remains constant—the intensity at least in parts of the area originally illuminated with the unmodified light beam is reduced.

Corresponding to the symmetry of light segments to be modified with the optical structure, one embodiment of the invention provides that the base area of each optical structural element is formed by a rectangle.

In theory it can also be possible, depending on the application case, for both rectangular and square optical structural elements to be used together, however it is preferable for all optical structural elements to have identical base areas, both with respect to shape and preferably also with respect to dimensions.

In the same way, it can be provided that the base area of each optical structural element is formed by a square.

Thus, the optical structural elements are arranged in a rectangular, preferably a square grid, one structural element occupying the entire area between each four vertices that are formed by the grid points.

With rectangular, especially square structural elements it is possible to realize a rectangular or square spread function, by means of which especially the "intersection areas" of four adjacent light segments can be optimally illuminated to increase the homogeneity of the light pattern.

A specific preferred embodiment of the invention provides that the optical structural elements have, in their center, a central elevation, preferably with a circular or elliptical base.

The circularity of the base refers in turn to the projection of the defined surface, on which the optical structural elements are arranged, into a plane.

Preferably, to be able to cover the defined surface completely, it is provided that the base of the central elevation extends to the four delimiting sides of the quadrilateral base area.

Among other things, it is advantageous for manufacturing if the central elevation has a continuous course over its entire surface. In addition, this allows better adjustment of the spread properties.

A desired symmetrical spread function provides that the central elevation has its maximum distance to the base area at the geometric center of its base area.

Furthermore, it is advantageously provided that the central elevation has its minimum distance to the base area on its circumference.

In particular, it is provided, that the minimum distance of the circumference to the base area is equal to zero.

Furthermore, a specific embodiment, in particular the above-described specific embodiment, also provides that the structural elements have, in their vertex areas, vertex area elevations, each of which is formed by a lateral face of a pyramidal elevation.

The pyramidal elevations make it possible to "install" a microstructure that itself is circular, that is a microstructure (an optical structural element) with a circular base, into a rectangular, in particular square grid, and achieve, in this way, 100% coverage of the defined surface on which the optical structure is arranged.

It is advantageously provided that all structural elements lying on a vertex of the grid contribute to the pyramidal elevation.

Thus, the four lateral faces of the structural elements lying at a grid point together form the pyramidal elevation. This pyramidal elevation is delimited by four vertices, preferably symmetrically arranged around the grid point. Each of these vertices lies on a delimiting side of a structural element involved in the elevation, the vertices preferably lying exactly in the middle of these delimiting sides.

Adjacent vertices of the pyramidal elevation are connected with one another by curved, in particular inward curved or inward bent delimiting sides.

With respect to symmetry, it is especially advantageous for the apex of a pyramidal elevation to lie exactly over a grid point of the grid.

Furthermore, it is advantageously provided that each of the optical structural elements is designed to be symmetrical about its diagonal, in particular to have mirror symmetry.

A specific embodiment of the invention provides that in a section through a pyramidal elevation in a plane normal to the base area along a diagonal the vertex area elevations have an essentially linear slope.

It can be provided that in a section through a pyramidal elevation in a plane normal to the base area along a delimiting side the vertex area elevations have an essentially concave course.

Finally, it is also advantageously provided that the central elevation and e vertex area elevations continuously transition into one another.

This makes the optical structures substantially simpler to produce, since continuous surfaces are substantially easier to mold, for instance in an injection molding process, than non-continuous surfaces are.

In general, with the circular structure each individual light segment is somewhat blurred, especially in the area of its sharp delimiting edges. The fact that the entire base area is occupied by optical structural elements as a consequence of the 100% filling of the area, means that the delimiting edges are no longer absolutely sharp. The pyramidal elevations additionally allow the area between four adjacent light segments to be optimally illuminated, so that all areas between the light segments have a homogeneous light pattern, and when one (or more) light segment(s) of the masked area is/are turned off the delimiting lines are sufficiently sharp, but with a blurred delimiting side, so that it is not perceived as annoying.

One embodiment of the invention provides that the optical structure is arranged on at least one, preferably exactly one boundary surface of an optical element that is designed in the form of a headlight lens or in the form of a cover plate of the lighting device.

Thus, the "defined surface" mentioned at the beginning lies on this at least one, preferably exactly one boundary surface of an optical element, which is designed as a headlight lens or cover plate.

In another embodiment, the optical structure is arranged on at least one surface of an optical element in the form of a lens, in particular a projector lens of the lighting device.

Thus, the "defined surface" lies on a surface of a lens.

Preferably, the optical structure is arranged on the light exit side of the lens.

Thus, the optical structure is preferably arranged on the curved light exit surface the lens, preferably the projector lens.

It is especially advantageous for the structural elements of the optical structure to be distributed over the entire at least one surface of an optical element.

Thus, the "defined surface" is formed by the entire surface or boundary surface of the optical element.

Furthermore, it is especially advantageous for all structural elements to be essentially identical.

Each structural element modifies the luminous flux passing through it in an identical way to all other structural elements.

Here "essentially" identical means that on a planar surface on which the structural elements are arranged, they actually are identical.

In the case of curved surfaces, the structural elements are identical in their central area, while the curvature of the surface can make the edge areas of different structural elements (slightly) differ from one another.

A specific embodiment correspondingly provides that all structural elements are identical with respect to a planar surface or an imaginary planar surface.

Accordingly, the structural elements are calculated for a planar surface; if these identical structural elements calculated in this way are placed—with identical orientation—on a curved surface of a lens, for example, then the structural elements are still, as already mentioned above, identical in their central area; however, in the transitional areas to the original lens surface on which the structural elements are placed, the structural elements have, due to curvature of the lens surface, a different shape, depending on their position on the lens surface, which, however, given the small size of the structural elements has no effect, or only a very small effect, on the resulting light pattern.

Furthermore, it is advantageous for all structural elements to be identically oriented.

In a planar defined surface, this does not require any further explanations. In the case of curved surfaces (for example, a lens), the structural elements are identically arranged along axes through the surface, all of these axes running parallel to an axis of symmetry or to an optical axis of the surface (and not normal to the surface normal).

This has advantages, especially for manufacturing, since this makes it simple to remove the optical structure and the tool to produce the structure, since no undercuts can form on the optical structure.

The inventive optical structure can optimally be produced if the spread function is a point spread function (PSF).

Furthermore, it is advantageous that the symmetry of a structural element depends on the symmetry of the spread function PSF. The structural element generally has the same symmetry class as the PSF. For example, if the PSF has horizontal mirror symmetry, then the structural element also has horizontal mirror symmetry.

Furthermore, it is advantageously provided that the dimension of a structural element, for example a diameter and/or a height of the structural element, is greater, especially very much greater than the wavelength of visible light, so that diffraction effects can be avoided.

In particular, it is advantageously provided that the height of the structural elements lies in the μm range.

For example, the height of the structural elements lies in the range of 0.5-5 μm, preferably in the range of 1-3 μm.

In a specific embodiment, the height of the structural elements is about 2.7 μm.

Furthermore, a specific embodiment, e.g. variants with the above-described heights, provides that the diameter or a length of the structural elements lies in the millimeter range.

For example, if the diameter or a length of the structural elements lies between 0.5-2 mm, diameter or a length of the structural elements is about 1 mm.

In a sample embodiment of a lens on which the structural elements are arranged, the diameter of the lens is 90 mm.

It is simple to produce an optical structure if the defined surface on which the structural elements are distributed is subdivided into an imaginary, preferably regular grid structure, and if the structural elements are arranged on the grid points or between the grid points of the grid structure.

Such an arrangement is advantageous, especially also with respect to an optimal optical effect of the optical structure, since it allows the optical effect of the optical structure to be optimally adjusted.

Here in the case of a curved optical surface on which the optical structure is arranged, the "regularity" of the structure is to be seen with respect to a projection of this defined surface into a plane, the small grid distances making it possible to consider the grid to be planar in the area of adjacent grid points, even in the case of a curved defined surface.

Preferably, it is provided that exactly one structural element is arranged on each grid point or between the grid points of the grid structure.

Moreover, it can be provided that adjacent structural elements change into one another, i.e., they are arranged to touch one another, or the structural elements are isolated from one another, i.e., are arranged not to touch one another.

A specific embodiment of the invention provides that adjacent grid points are separated by about 0.5-2 mm, preferably about 1 mm.

It is optically optimal if the transition of the structural elements to the defined surface is continuous, preferably of continuity class $C^2$, i.e., with continuous tangents.

An above-described optical structure is especially well suited for a lighting device that is set up to project the light emitted from it in the form of a masked light pattern, in particular a low beam pattern, the masked light pattern, in particular the low beam pattern, having a light/dark boundary, wherein the inventive optical structure, in particular the structural elements or the spread function is/are designed in such a way to reduce the gradient of the light/dark boundary of the unmodified light pattern of the lighting device.

As is described in detail in DE 10 2008 023 551 A1, excerpts of which are repeated here, the "softness" of the transition is described by the maximum of the gradient along a vertical section through the light/dark boundary at −2.5° horizontal. To do this, the logarithm of the illuminance is calculated at measurement points vertically separated from one another by 0.1°, and their difference is taken, producing the gradient function. The maximum of the gradient function is designated as the gradient of the light/dark bright boundary. The greater this gradient is, the sharper the light/dark transition is. The vertical position of the maximum of this function also describes the place where the so-called light/dark boundary is recognized, that is, the place the human eye perceives as the borderline between "light" and "dark" (at about −0.5° vertical).

A lighting device without an inventive optical structure produces a low beam pattern with a light/dark boundary having a certain sharpness, described by the so-called "gradient". Providing an inventive optical structure modifies this unmodified light pattern to reduce the sharpness of the light/dark boundary, so that it meets the legal requirements and is perceived as pleasant by the human eye.

In the same way, an inventive optical structure is advantageous for a lighting device that is set up to project the light emitted from it in the form of a masked light pattern, in particular a low beam pattern, the masked light pattern, in particular the low beam pattern, having a light/dark boundary, wherein the inventive optical structure, in particular the structural elements or the spread function is/are designed in such a way that part of the luminous flux of the lighting device is projected into an area above the light dark boundary.

This optimally makes it possible, with the inventive optical structure, to produce a sign light described at the beginning, in which, for example, each optical structural element deflects a small proportion of the luminous flux passing through the structural element into a corresponding area.

In particular, it is advantageous that it is possible with an inventive optical structure both to adjust the gradient of the light/dark boundary and also to produce a sign light. The prior art requires two optical structures to accomplish this, a first structure to produce one of the two optical "effects", and a second structure superimposed on the first, which produces the second optical "effect". The inventive optical structure achieves this by a structure consisting of essentially identical structural elements that are designed as described above to "realize" a spread function.

A specific embodiment provides that the luminous flux deflected by the optical structure lies in an area between 1.5° and 4°, especially between 2° and 4° above the HH line.

A sample embodiment of the invention provides that the optical structure deflects 0.5-1% of the luminous flux of the lighting device into an area above the light/dark boundary.

An inventive optical structure is also advantageous for a lighting device that is set up to project the light it emits in the form of individual light patterns that are imaged in n rows and m columns, where $n>1$, $m\geq1$ or $n\geq1$, $m>1$, and that together form an entire light pattern, for example a high beam pattern, the invention providing that the optical structure, in particular the structural elements or the spread function is are designed in such a way to deflect at least part of the luminous flux of the lighting device into the border areas, in each of which two individual light patterns border one another.

"Building" an entire light pattern out of individual light patterns has the advantage that, e.g., as described above, masking individual light segments (individual light patterns allows certain areas to be masked. To accomplish this, it is advantageous for the individual light patterns to have comparatively sharp borders, which however is accompanied by the disadvantage that an optical grid structure can form, with dark or dimmed areas between the light segments, which can be perceived as visually unpleasant and also might not be legally permissible.

The invention makes it simple to emit sufficient light into these dark or dimmed areas between the light segments, so that this grid structure is no longer visible.

This is especially advantageous if adjacent individual light patterns of the unmodified light pattern have a defined distance(s) to one another.

A specific embodiment provides that the individual light patterns of the unmodified light pattern have a rectangular or square shape, especially when projected onto a vertical plane.

In particular, it provides that all distances between adjacent individual light patterns are identical in the horizontal direction.

Furthermore, it can alternatively or preferably additionally also be provided that all distances between adjacent individual light patterns are identical in the vertical direction.

A specific embodiment provides that the individual light patterns have a width and/or a height of about 1°.

Typically, the distance between two adjacent individual light patterns is less than or equal to 0.5° and greater than 0°.

For example, the distance between two adjacent individual light patterns is less than or equal to 0.2°.

For example, the distance between two adjacent individual light patterns lies between 0.05° and 0.15°.

Furthermore, it can also be provided that the distance between two adjacent individual light patterns is less than or equal to 0.1°.

In a specific embodiment, the average luminous intensity in a gap between two individual light patterns produced with the luminous flux that is intended for an individual light pattern corresponds to half the average luminous intensity in a bordering individual light pattern of the modified light pattern, so that the total luminous intensity that is produced with light that is intended for the two bordering individual light patterns essentially corresponds to the luminous intensity of the individual light patterns of the modified light pattern.

Preferably, the luminous intensity in all individual light patterns is essentially identical, and in the same way it is advantageous for the intensity in the individual light patterns to be essentially homogeneous over the entire surface of the individual light pattern.

As has already been mentioned above, it is especially advantageous if the optical structure deflects part of that luminous flux that would, without an optical structure, produce exclusively one individual light pattern, into the gap areas that frame this individual light pattern and that result from the spacing apart of the individual light patterns from one another.

The dark edge areas around the individual light patterns are thus illuminated exclusively with light from individual light patterns bordering these edge areas, so that when individual light patterns are turned off the turned-off areas in the entire light pattern continue to appear dark, and are not illuminated by scattered light from other individual light patterns.

It is preferably provided that starting from a viewed individual light pattern, the luminous intensity in a bordering gap decreases in the direction toward the adjacent individual light pattern, this decrease preferably having a linear course.

Since a gap is illuminated with part of the light that is intended for the two bordering individual light patterns (in the area where the gaps intersect, part of the light of four individual light patterns), an approximately constant luminous intensity results over the entire gap, especially if the intensity has a linear course.

In particular, it is provided that the luminous intensity decreases to zero.

Moreover, it is also advantageously provided that the luminous intensity in a gap directly bordering the edge of the viewed individual light pattern essentially corresponds to the luminous intensity of the individual light pattern of the modified light pattern at its edge or the average luminous intensity in the individual light pattern of the modified light pattern.

It is generally advantageous for the optical structure to be arranged and/or designed in such a way that essentially the entire luminous flux, preferably the entire luminous flux of the lighting device impinges on the optical structure.

This allows the entire luminous flux to be used for modification of the original light pattern.

It is especially advantageous for the optical structure to be arranged and/or designed in such a way that it is essentially homogeneously illuminated.

Finally, the invention relates to one more lighting device with a east one, preferably exactly one, above-described optical structure.

For example, the lighting device is a projection system.

In this case, it is preferably provided that the lighting device comprises at least one light source, at least one reflector, and at least one lens, in particular a projector lens, and it preferably being provided that the at least one optical structure is arranged on the lens and/or on an additional cover plate or headlight lens.

However, it can also be provided that the lighting device is a reflecting system.

In this case it is advantageous for the lighting device to comprise at least one freeform reflector and at least one light source and at least one headlight lens and/or at least one cover plate, the at least one optical structure advantageously being arranged on the at least one headlight lens and/or at least one cover plate and/or an additional cover plate or headlight lens.

Figure 2:
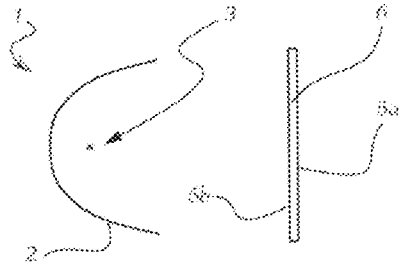
Figure 3:
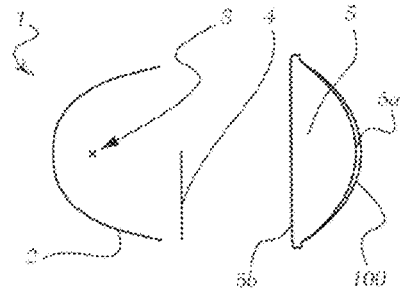
Figure 4:
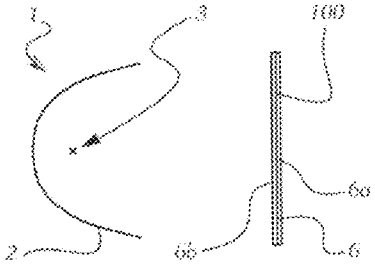
Figure 5:
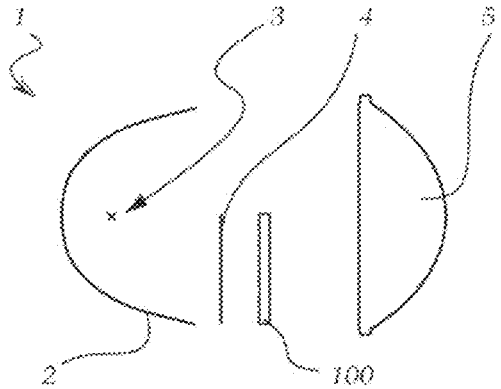
Figure 6:
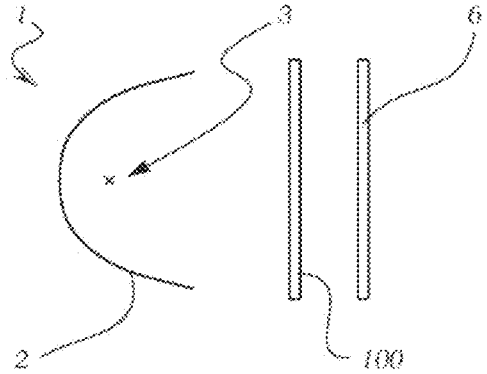
Figure 7:
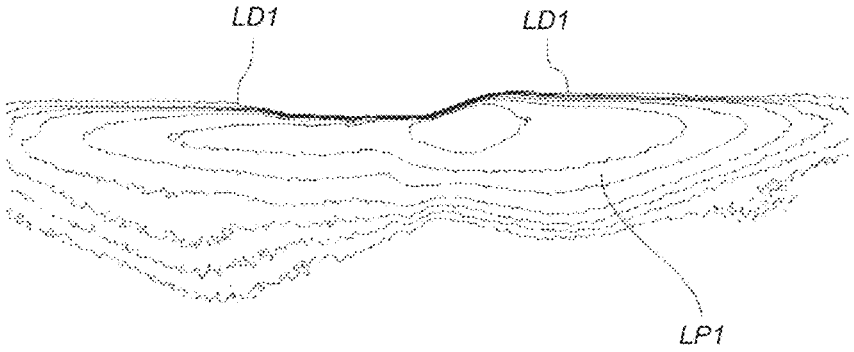
Figure 7A:
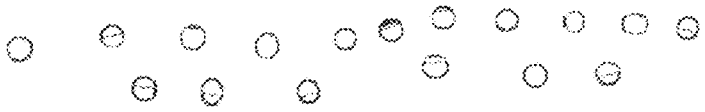
Figure 7B:
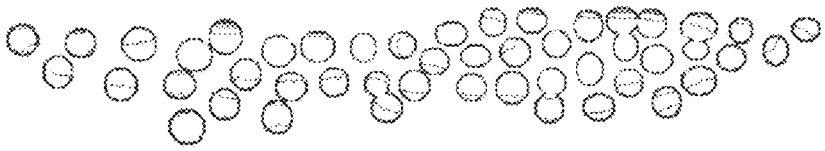

The invention is described detail below using the drawing. The figures are as follows:

FIG. 1 a schematic representation of a prior art projection module;

FIG. 2 a schematic representation of a prior art reflection module;

FIG. 3 a schematic representation of a projection module with an inventive optical structure on the outside of a lens;

FIG. 4 a schematic representation of a reflection module with an inventive optical structure on the outside of a cover plate or headlight lens;

FIG. 5 a schematic representation of a projection module with an inventive optical structure on an additional optical element such as a glass pane;

FIG. 6 a schematic representation of a reflection module with an inventive optical structure on an additional optical element such as a glass pane;

FIG. 7 a "conventional" unmodified low beam pattern produced with a prior art lighting device;

FIG. 7*a* individual light spots taken from areas produced by a prior art lighting device;

FIG. 7*b* a larger number of light spots as shown in FIG. 7*a;*

Figure 8:
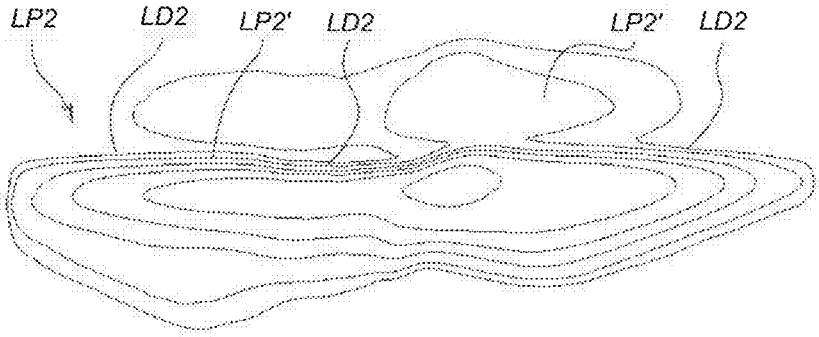
Figure 8A:
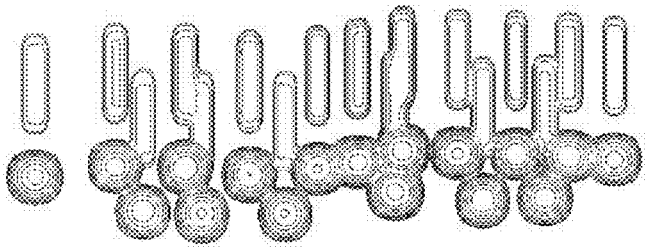
Figure 8B:
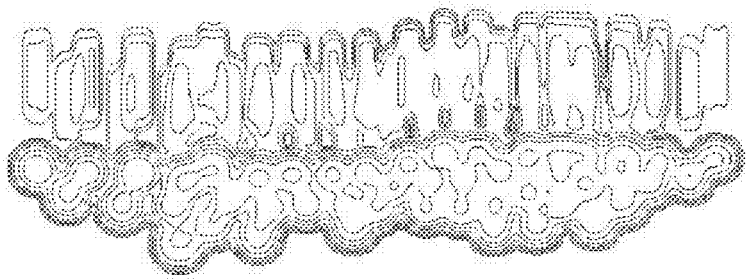
Figure 9:
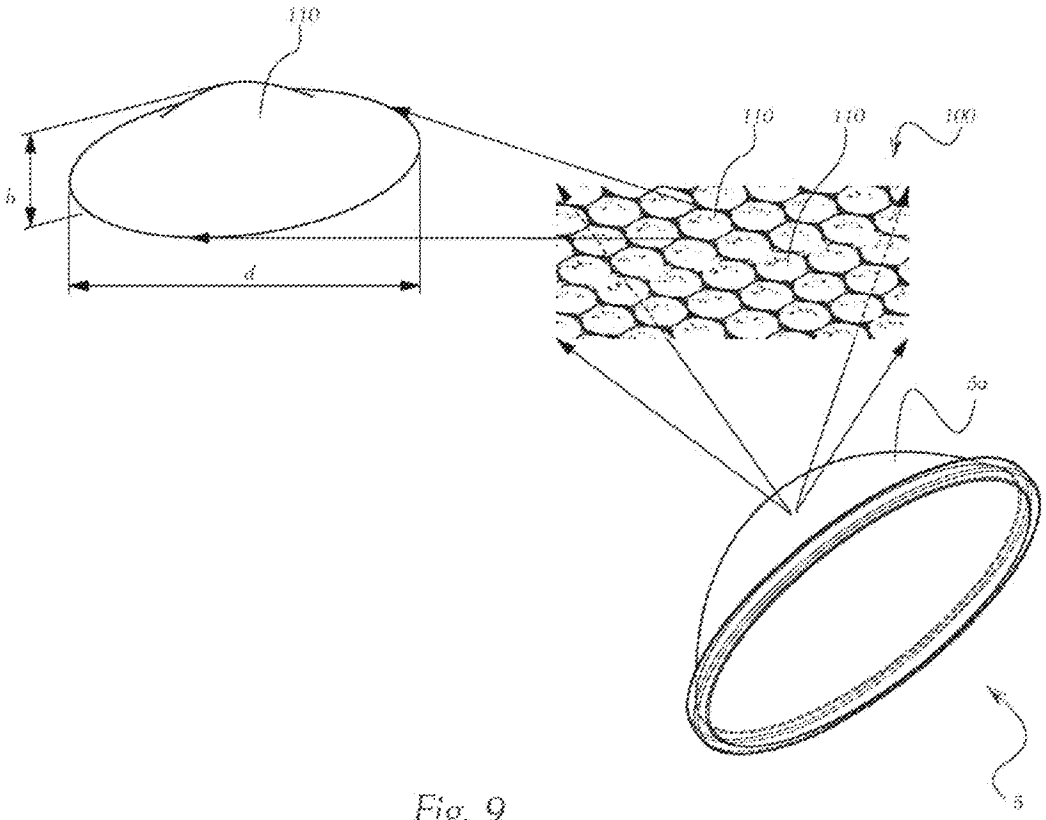
Figure 11:
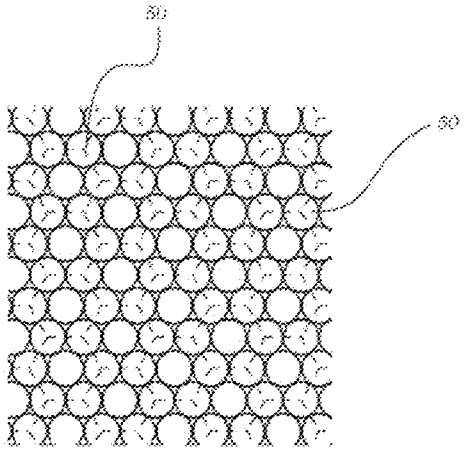
Figure 10:
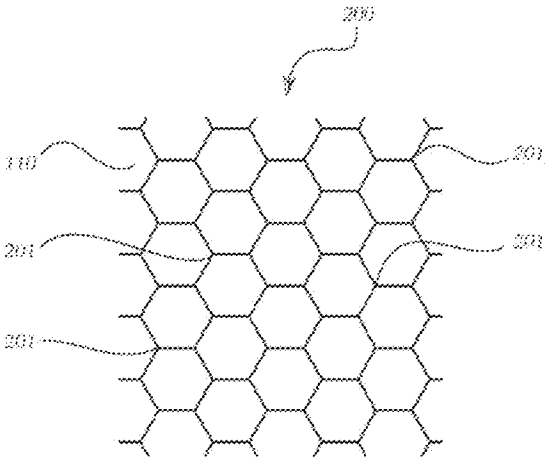
Figure 12:
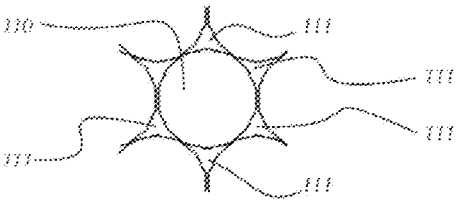
Figure 13:
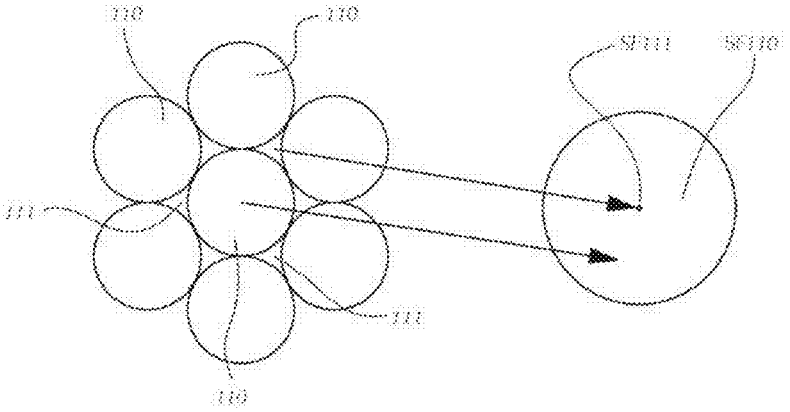
Figure 14:
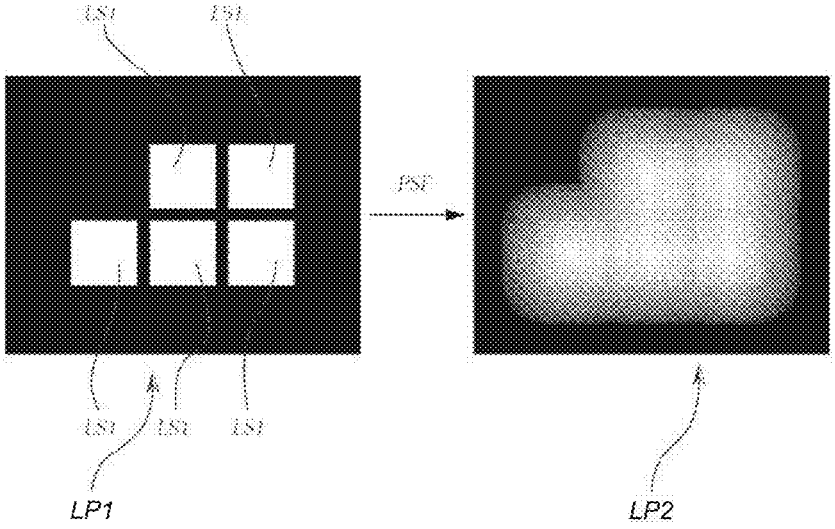
Figure 15:
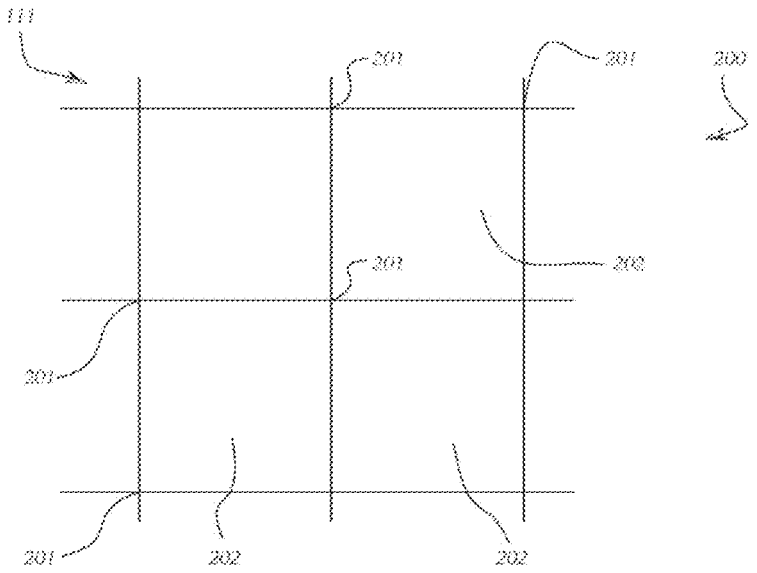
Figure 20:
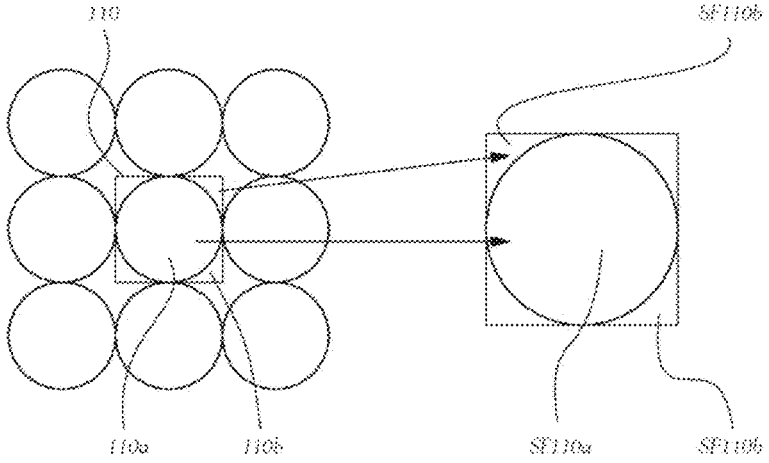
Figure 16:
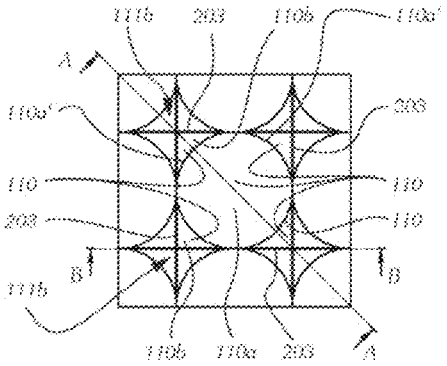
Figure 17:
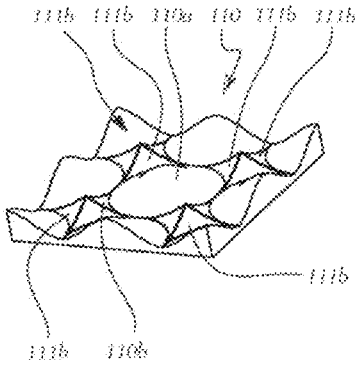
Figure 18:
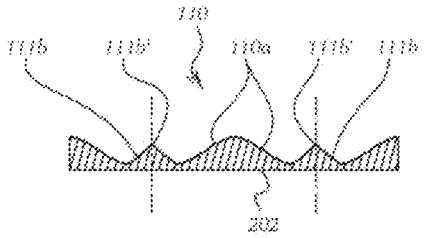
Figure 19:
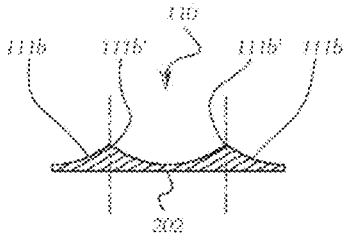
Figure 21:
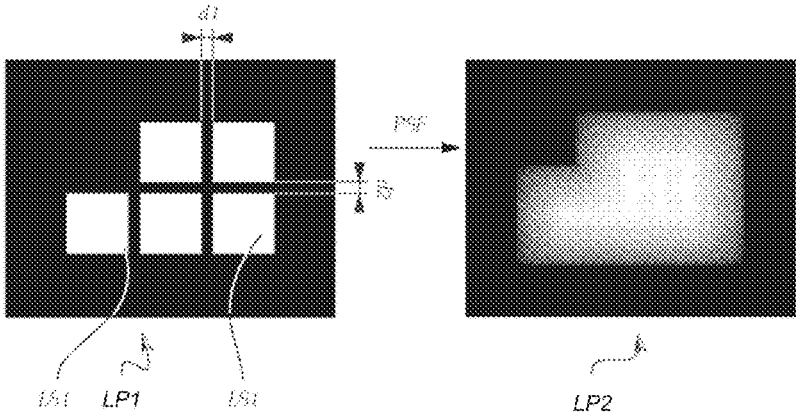
Figure 22:
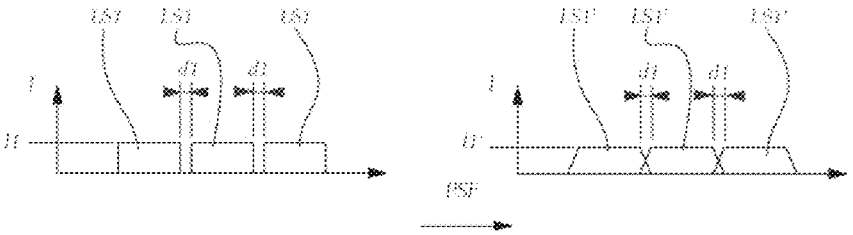

FIG. 8 a modified low beam pattern produced with a lighting device having an inventive optical structure;

FIG. 8*a* the light spots from FIG. 7*a*, modified according to a spread function for combined gradient softening and production of a sign light;

FIG. 8*b* the light spots from FIG. 7*b*, correspondingly modified with the spread function;

FIG. 9 a three-dimensional view of a lens with an optical structure, an enlarged representation of a detail of the lens, and furthermore an even more enlarged detail of the already enlarged detail;

FIG. 10 a hexagonal grid structure;

FIG. 11 the grid structure shown in FIG. 10, occupied with optical structural elements having a circular base;

FIG. 12 an enlarged representation of the optical structure from FIG. 11 in the area of an optical structural element;

FIG. 13 a schematic diagram of a hexagonal arrangement of optical structural elements (microstructures) with a circular base and a light pattern produced with it;

FIG. 14 a light pattern built of square light segments, and their projection shown through an optical structure such as in FIG. 13;

FIG. 15 a grid structure on a defined surface, on which the optical structural elements of an inventive optical structure are arranged;

FIG. 16 a top view of the grid from FIG. 15 in the area of an optical structural element along with directly bordering structural elements;

FIG. 17 a perspective view of the detail in FIG. 16;

FIG. 18 a section along the line A-A in FIG. 16;

FIG. 19 a section along the line B-B in FIG. 16;

FIG. 20 a purely schematic illustration of the effects of a structural element having a square base area on a light pattern;

FIG. 21 an unmodified light pattern built from square light segments and the projection of the luminous flux forming this light pattern by means of an optical structure with square structural elements; and FIG. 22 the schematic course of the luminous intensity in an unmodified and in a modified light pattern.

The following discussion will first refer to the FIGS. 1-6, which show the principle possibilities of arranging an inventive optical structure, without limiting the subject matter for which protection is sought. An inventive optical structure can also be used in other than the lighting devices for motor vehicles shown here.

FIG. 1 schematically shows a lighting device 1 in the form of a projection system, with a reflector 2, a light source 3, an (optional) diaphragm arrangement 4, and a projector lens 5, with a curved outside 5*a* and a planar inside 5*b*.

FIG. 2 schematically shows a lighting device 1 in the form of a reflecting system, with a reflector 2, a light source 3, and a headlight lens or cover plate 6, and reference numbers 6*a* and 6*b* referring to the outside and inside of the glass pane 6.

FIG. 3 is a schematic representation of the projection system from FIG. 1, wherein an inventive optical structure 100 is arranged on the outside of a lens 5. This optical structure 100 preferably occupies the entire outside 5*a* of the lens 5.

FIG. 4 shows a schematic representation of the reflection module from FIG. 2 with an inventive optical structure 100 on the outside of a cover plate or headlight lens 6, wherein the optical structure preferably occupies the entire outside of the glass pane 6.

FIG. 5 once again shows a schematic representation of a projection module 1, as shown in FIG. 1, with an inventive optical structure 100 on an additional optical element such as a glass pane, wherein the optical element is arranged between the diaphragm 4 and the lens 5.

Finally, FIG. 6 shows one more schematic representation of a reflection module from FIG. 2, with an inventive optical structure 100 on an additional optical element such as a glass pane, which is arranged between the light source 3 and the headlight lens or cover plate 6.

As was already mentioned, these representations only serve to illustrate some of the possible ways of arranging an inventive optical structure 100. In theory, a lighting device can also have multiple light sources, for example LEDs, as light sources, and the light-forming body can be in the form of one or more optical waveguides, reflectors, etc.

The optical structure 100 of the lighting device 1 is generally associated with the lighting device 1, or is part of it in such a way that the optical structure 100 is transilluminated by essentially the entire (or the entire optically relevant) luminous flux of the lighting device 1.

It is especially advantageous for the optical structure to be arranged and/or designed in such a way that it is homogeneously illuminated. The spread function allows the optical structure to be calculated in this case by making it simple to derive how strongly what fraction of the entire surface should refract.

FIG. 7 schematically shows a "conventional", unmodified low beam pattern LP1 as is produced, for example, with a known prior art lighting device 1 shown in FIG. 1. The low beam pattern LP1 has a light/dark boundary LD1, which has an asymmetric course in the case shown.

For better illustration of the effect of an inventive optical structure 100, FIG. 7*a* shows individual light spots taken out of the light pattern LP1, and FIG. 7*b* shows an even larger number of such light spots.

If we now consider FIG. 8, it shows a modified light pattern LP2 that is created through modification of the original light pattern by the optical structure 100. The modified light pattern LP2 results from convolution of the unmodified light pattern LP1 with a spread function PSF, wherein the optical structure 100 is designed in such a way that the unmodified light pattern LP1 is modified according to the spread function PSF into the new light pattern LP2.

This modified light pattern LP2 has essentially the same shape as the unmodified light pattern LP1, and also has a light/dark boundary LD2 that has, however, a smaller gradient, as is schematically indicated by the greater separation of the isolux lines in the area of the light/dark boundary. Thus, the light/dark boundary LD2 is "softer".

It can also be seen in FIG. 8 that an area LP2' above the light/dark boundary LD2 is also illuminated with a certain intensity to produce a sign light.

Thus, in the example shown, a lighting device without an inventive optical structure produces a low beam pattern LP1 with a light/dark boundary LD1 having a certain sharpness, described by the so-called "gradient". Providing an inventive optical structure 100 modifies this unmodified light pattern LP1 to reduce the sharpness of the light/dark boundary, so that it meets the legal requirements and is perceived as pleasant by the human eye.

In addition, the described embodiment projects part of the luminous flux of the lighting device 1 into an area LP2' above the light/dark boundary LD2. This optimally makes it possible, with the inventive optical structure 100, to produce a sign light described at the beginning, in which, for example, each optical structural element deflects a small proportion of the luminous flux passing through it to a corresponding area.

In the specific embodiment shown, the luminous flux deflected by the optical structure lies in an area LP2' between 1.5° and 4°, especially between 2° and 4° above the HH line.

A sample embodiment of the invention provides that the optical structure deflects 0.5-1% of the luminous flux of the lighting device 1 into an area LP2' above the light/dark boundary LD2.

If we consider FIGS. 8*a* and 8*b*, they show the individual light spots as shown in FIGS. 7*a* and 7*b*, modified by an inventive optical structure 100 for gradient softening and simultaneous production of a sign light. As can be seen, the individual light spots are smeared (softened), at least in the area of the light dark boundary, and a (small) part of the luminous flux that contributes to the light spots shown in FIGS. 7*a* and 7*b* when there is no optical structure is simultaneously deflected into an area above these light spots, to form a sign light.

FIG. 9 once again shows, as an example, the already known lens 5, which has, on its outside, an optical structure 100 that consists of individual structural elements 110. An individual structural element 110 with a diameter d and a height h is also schematically shown in FIG. 9.

Returning once again to FIG. 9, it can be seen that in the embodiment of the invention shown, the bases of the structural elements 110 have a circular cross section. In the case of a curved defined surface that has the structural elements arranged on it, the projection of the base—that is the area on the defined surface occupied by a structural element—is viewed in a plane.

Thus, structural elements are preferably essentially rotationally symmetric, but can have, depending on the application, different deformations, i.e., deviations from this rotationally symmetric structure; it is possible for these deformations to cover a large area, but as a rule they are local.

The structural elements 110 are arranged on the grid points 201 of a hexagonal grid 200 (see FIG. 10). FIG. 11 shows how a structural element 110 with a circular base sits on each grid point 201 of the grid structure 200.

In the embodiment shown, in which the grid structure forms a hexagonal grid 200, it is possible for about 87% of the defined surface to be filled with structural elements 110, about 13% of the unmodified surface 111 (see FIG. 12) is not covered by a structural element.

An above-described optical structure with optical structural elements having a circular base in a hexagonal grid is especially well suited for the case, which is explained using FIGS. 7 and 8, of gradient softening of the LD line of a low beam pattern, possibly together with production of a sign light.

When used in connection with segmented light patterns, especially those having a quadrilateral shape, such above-described optical structural elements are often not optimal, as is explained below.

FIG. 13 once again shows the hexagonal arrangement of the microstructures optical structural elements) 110 already described above, wherein the microstructures 110 have a circular base. The microstructures 110 have unstructured places 111, that is unmodified areas (for example, of a lens surface) located between them, as is also shown in FIG. 12.

While the microstructures 110 with a circular base provide a circular spread function SF110, see FIG. 13 on the right, that is they scatter light (i.e., a light beam) into a circular area (when projected into a plane), the unmodified area 111 does not scatter, and a point of an object (i.e., e.g., of a light source) is "ideally" projected as a point SF111. Thus, the scattering pattern of an optical structure from FIG. 13 has a maximum in its center.

But this means that the unchanged areas 111 of the (lens) surface produce an ideal image of the object, and thus sharply delimited light segments that are to be projected have sharp segment boundaries, i.e., when such an optical structure is used the sharp segment boundaries are still preserved.

FIG. 14 shows, in its left area, a schematic light pattern LP1 that is formed from multiple light segments LS1. In this example, the light segments LS1 are rectangular, have sharp delimiting sides, and adjacent light segments are slightly separated from one another.

If this light pattern LP1 is projected through an optical structure, as shown in FIG. 13, then the result is a light pattern LP2, as is shown in FIG. 14 on the right. On the one hand, as described using FIG. 13, the delimiting sides of the light segments are still sharply imaged, even if weakened in comparison with the original light pattern LP1; on the other hand it is striking that the circular base of the microstructures 111 (and thus a circular spread function PSF) make it difficult to illuminate the vertex areas between the light segments.

Thus, although a circular spread function or microstructure elements 110 with a circular base can soften the disadvantageous grid effect, i.e., dark stripes between the light segments, as can clearly be seen in FIG. 14, left picture, the result is not optimal.

FIG. 15 shows a defined surface 111, for instance the planar inside or outside of a glass pane or the light entrance or light exit surface of a lens. In the case of a curved surface of a lens, the surface 111 represents a projection of this curved surface into a plane, preferably into a plane that is normal to the optical axis of the lens.

The surface 111 is subdivided into an (imaginary) grid 200 that has, in the preferred case shown, a square structure. Each surface 202 between four vertices 201 is completely covered by the base area of exactly one optical structural element 110, so each light-scattering structural element 110 has one square base area.

The quadrilateral base area of the optical structural elements is delimited by straight sides, i.e., each pair of adjacent vertices of the base area of an optical structural element is connected with a straight side, this statement referring to a planar grid.

The essence of this invention is that the fact that the grid is quadrilateral and the base area of the structural element occupies the entire surface of a grid cell allows the entire surface of the "basic structure" to be used for modification of the light pattern. A hexagonal grid with circular structural elements, which also fills a very high proportion of about 90% of the area with the structural elements, still leaves a small proportion of about 10% of the base area unmodified, so it does not contribute to modifying the light pattern.

A parallel patent application of the applicant describes an optical structure mentioned at the beginning that is formed of optical structural elements which have a circular base and are arranged in a hexagonal grid. In such a hexagonal arrangement, about 91% of the curved boundary lens surface can be covered with structural elements, but about 9% of the lens surface remains uncovered. When such a lens is used to project sharply delimited light segments. e.g., rectangular light segments, these uncovered areas of the lens surface cause the light segments to have sharp edges, and thus produce inhomogeneities in the light pattern.

This arrangement, in which the lens surface is 100% covered with the structural elements, makes it possible to produce a homogeneous light pattern, even with sharply delimited light segments that the lens projects into an area in front of the vehicle, as will still be explained.

The quadrilateral shape of the base area of the structural elements, whose symmetry preferably corresponds to that of the light segments, additionally allows optimal illumination of the vertex areas between four light segments, which is impossible with structural elements having a circular base.

Corresponding to the symmetry of the light segments LS1 (see FIG. 14) to be modified with the optical structure, the embodiment of the invention that is shown thus provides that the base area of each optical structural element 110 has the shape of a square 202.

A specific embodiment of a structural element 110 is discussed in detail below with reference to FIGS. 16-19. The grid 200 is completely occupied with such structural elements, all structural elements being identical and identically oriented on imaginary planar surface 111.

As can be seen in FIGS. 16-19, the optical structural element 110 has, in its center, a central elevation 110*a* with a circular base. To be able to cover a square 202 completely, it is provided that the base 110*a*' of the central elevation 110*a* extends to the four delimiting sides 203 of the quadrilateral base area 202 of the structural element 110.

Preferably, the central elevation 110*a* has a continuous course over its entire surface.

The central elevation 110*a* has its maximum distance to the base area at the geometric center of its base area, that is, it reaches its maximum height at the geometric center of the square 202.

The central elevation 110*a* has its minimum distance to the base area 111/202 on its circumference; in the embodiment shown this distance is >0.

In the vertex areas, the structural element 110 has a vertex area elevation 110*b*. This vertex area elevation 110*b* is formed by a lateral face of a pyramidal elevation 111*b*.

The pyramidal elevations make it possible "install" a microstructure that itself is circular, that is a microstructure (an optical structural element) with a circular base, into a rectangular, in particular square grid, and achieve, in this way, 100% coverage of the defined surface on which the optical structure is arranged.

Pyramidal elevations sit at all vertices 201 of the grid 200, and thus the four lateral faces 110*b* of the structural elements lying at a grid point together form the pyramidal elevation. A pyramidal elevation 111*b* is delimited by four vertices, symmetrically arranged around the grid point 201. Each of these vertices lies on a delimiting side of a structural element 111 involved in the elevation 111*b*; in the example shown, the vertices lie in the exact middle of these delimiting sides 203.

Adjacent vertices of the pyramidal elevation are connected with one another by curved, in particular inward curved or inward bent delimiting sides.

The apexes 111*b*' of the pyramidal elevations 111*b* lie exactly over a grid point 201 of the grid 200, as shown.

The optical structural element 110 shown is symmetric about its diagonal A-A, in particular it has mirror symmetry.

It can also be seen that in a section through the pyramidal elevation 111*b* in a plane normal to the base area 202 along the diagonal A-A, the vertex area elevations 110*b* have an essentially linear slope toward its apex 111*b*' (FIG. 18).

In addition, it can be provided that M a section B-B through a pyramidal elevation 111*b* in a plane normal to the base area 202 along a delimiting side 203 the vertex area elevations 110*b* have an essentially concave course (FIG. 19).

Preferably, it is provided that the central elevation 110*a* and the vertex area elevations 110*b* continuously transition into one another. This makes the optical structures substantially simpler to produce, since continuous surfaces are substantially easier to mold, for instance in an injection molding process, than non-continuous surfaces are. This transition preferably has continuity class $C^0$.

FIG. 20 schematically shows the "effects" of a structural element compared with FIG. 13. As in FIG. 13, the circular structure 110*a* also produces (similarly to the microstructure 110 in FIG. 13) a circular scatter SF110*a* of a light beam. But while the unmodified area 111 in FIG. 13 leads to an "ideal" projection SF111 of the light passing through the area 111, in a structural element 110 shown in FIG. 20 the area outside the circular structure 110*a* is provided with the structure 110*b*, as described above; in a simplified representation this structure scatters the light passing through it into the "vertex areas" SF110*b*, so that there is no "ideal projection" of a light beam without scattering, but rather light is partly scattered in way shown.

Specifically, it is provided that a modified light pattern LP2 is formed by convolution of an unmodified light pattern LP1 with a spread function PSF and that the optical structure 100 is designed in such a way that the unmodified light pattern LP1 is modified according to the spread function.

An optical scattering element with an angular, in particular a quadrilateral, preferably a square base area implements an angular, in particular quadrilateral, preferably square spread function (see FIG. 20), with the advantages described especially for segmented, angular, in particular quadrilateral, preferably square light segments.

Thus, the invention provides that the entire optical structure is viewed and is correspondingly modified or formed through a spread function in such a way to produce the complete desired light pattern. In contrast to the prior art, this invention realizes the desired (modified) light pattern from an unmodified light pattern produced by the lighting device without an optical structure, by convolution of the unmodified light pattern with a spread function that produces the desired light pattern, and then shaping the entire optical structure so that it modifies the entire luminous flux of the lighting device so that a modified light pattern corresponding to the spread function results from the unmodified light pattern.

This involves distributing the structural elements 110 over at least one, preferably exactly one, defined surface 111 of at least one, preferably exactly one optical element 5, 6, it being especially advantageous for the optical structural elements 110 to be designed in such a way that every structural element 110 modifies the light beam passing through it according to the spread function PSF to produce a modified light beam LB2.

If we consider a certain (unmodified) light beam from the entire luminous flux, this light beam makes a certain contribution to the light distribution in the light pattern (the entire luminous flux produces the (entire) light pattern). A structural element now modifies a light beam passing through it in such a way that the unmodified contribution to the entire light pattern is changed according to the spread function. For example, the unmodified light beam contributes to a light pattern with a certain shape, i.e., certain areas on the road or on a plotting screen are illuminated, and other areas are not illuminated. The structural element now also illuminates areas outside the originally illuminated area with a certain intensity according to the spread function, while—since the entire luminous flux remains constant—the intensity is reduced in at least parts of the area originally illuminated with the unmodified light beam.

FIG. 21 once again shows, in the left picture, an unmodified light pattern as was already shown in FIG. 14 (left picture). An inventive optical structure as described above makes it possible to achieve a substantially better scatter than does a circular microstructure (see FIG. 14): the grid structure from FIG. 14 (right picture) is no longer recognizable in FIG. 21 (right picture), or is only still recognizable to an extent that is no longer annoying and conforms to the law.

As can be seen in FIG. 21, adjacent individual light patterns LS1 are separated in the horizontal direction by a distance d1, all distances d1 being identical. Furthermore, adjacent distributions LS1 are separated in the vertical direction by distances d2, all vertical distances being identical. Preferably it is also true that d1=d2.

The patterns or light segments LS1 typically have a width and/or a height of about 1°, although this is not a restriction. In the case of rectangular light segments, their vertical height is usually (somewhat) greater than their horizontal dimension.

The separation of the light segments LS1 forms dark columns in the light pattern. These columns' width (which corresponds to the distances d1, d2) is typically less than or equal to 0.5° and greater than 0°, as a rule less than or equal to 0.2° or less than or equal to 0.1°. A typical range for the width d1, d2 of the columns is between 0.05° and 0.15°.

The luminous intensity in all individual light patterns LS1 is essentially identical, and in the same way it is advantageous for the intensity in the individual light patterns LS1 to be essentially homogeneous over the entire surface of the individual light pattern, as is schematically indicated in FIG. 21, left side.

The optical structure deflects part of that luminous flux that would, without an optical structure, produce exclusively one individual light pattern (LS1) into the gap areas that frame this individual light pattern (LS1) an result from the spacing apart of the individual light patterns (LS1) from one another.

The dark edge areas around the individual light patterns are thus illuminated exclusively with light from individual light patterns bordering these edge areas, so that when individual light patterns are turned off the turned-off areas in the entire light pattern continue to appear dark, and are not illuminated by scattered light from other individual light patterns.

FIG. 22 schematically shows the course of the luminous intensity in an unmodified light pattern. In the light segments LS1 the luminous intensity I is constant at a value I=I1, and in the columns the intensity is I=0.

The optical structure now scatters part of the luminous flux that forms exactly one light segment LS1 into the bordering edges. This reduces the intensity in the modified light segments LS1' to a value I1' (the shape of the segments LS1' still corresponding to the unmodified light segments LS1), however part of the light for the original segment LS1 is scattered into the bordering edges. The amount of light scattered over the optical structure is selected (or the optical structure correspondingly shaped) in such away that in a gap such as is shown in FIG. 22, right side, the intensity is I=I1' at the edge of the viewed light segment LS1' and then linearly decreases to the value I=0, where I=0 is reached at the edge of the bordering light segment LS1'. This makes it possible to achieve a total intensity of I=I1' in the gap (FIG. 22), since the intensities of the scattered light from the two bordering light segments are added together.

Thus, with square structural elements 110 it is possible to realize a rectangular or, as shown, square spread function (FIG. 20, 21), by means of which the gaps and especially also the "intersection areas" of four adjacent light segments can be optimally illuminated to increase the homogeneity of the light pattern.

The fact that there are no unmodified areas makes the entire luminous flux passing through a structural element 110 scatter to a certain extent, so that in addition sharp edges are no longer projected as completely sharp, but rather are softened.

The fact that the entire base area is occupied by optical structural elements as a consequence of the 100% filling of the area, means that the delimiting edges are no longer absolutely sharp. The pyramidal elevations additionally allow the area between four adjacent light segments to be optimal illuminated, so that all areas between the light segments have a homogeneous light pattern, and when one (or more) light segment(s) is/are turned off the masked area is projected to be sufficiently sharp, but with a blurred delimiting side, so that it is not perceived as annoying.

It is generally advantageous for the dimension of a structural element 110, thus in the case shown the length of the diagonal or a side of the quadrilateral and/or the height (that is the maximum normal distance of the surface of the structural element from the defined surface) of the structural element 110, to be greater, in particular very much greater, than the wavelength of visible light, so that it is possible to avoid diffraction effects.

Specifically, the height of the structural elements 110 lies in the μm range.

For example, the height h of the structural elements 110 lies in the range of 0.5-5 μm, preferably in the range of 1-3 μm.

In a specific embodiment, the height of the structural elements 110 is about 2.7 μm.

Furthermore, in a specific embodiment, e.g., in variants with the above-described heights, it is provided that the length of the diagonal or the length of the sides of the base area of the structural elements 110 lies in the millimeter range.

For example, the length of the diagonal or the length of the sides of the structural elements 110 lies between 0.5-2 mm, preferably about 1 mm.

In a sample embodiment of a lens on which the structural elements are arranged, the diameter of the lens is 90 mm.

It is especially advantageous for the optical structural elements 110 to be designed in such a way that every structural element 110 modifies the light beam passing through it according to the spread function PSF to produce a modified light beam.

If we consider a certain (unmodified) light beam from the entire luminous flux, this light beam makes a certain contribution to the light distribution in the light pattern (the entire luminous flux produces the (entire) light pattern). A structural element now modifies a light beam passing through it in such a way that the unmodified contribution to the entire light pattern is changed according to the spread function. For example, if the unmodified light beam contributes to a light pattern with a certain shape, i.e., certain areas on the road or on a plotting screen are illuminated, other areas are not illuminated. The structural element 110 now also illuminates areas outside the originally illuminated area with a certain intensity according to the spread function PSF, while—since the entire luminous flux remains constant—the intensity is reduced in at least parts of the area originally illuminated with the unmodified light beam.

As was mentioned in connection with FIG. 9, it is advantageous for the entire defined surface 5*a* to be covered with the optical structural elements 110.

Furthermore, it is especially advantageous for all structural elements 110 to be essentially identical. Each structural element then modifies the luminous flux passing through it in an identical way to all other structural elements.

Here "essentially" identical means that in the case of a planar surface on which the structural elements are arranged, they actually are identical.

In the case of curved surfaces, such as in the case of a light exit surface 5*a* of a lens 5, each of the structural elements is identical in its central area, while the curvature of the surface can make the edge areas of different structural elements (slightly) differ from one another.

A specific embodiment correspondingly provides that all structural elements 110 are identical with respect to a planar surface or an imaginary planar surface 111.

Accordingly, the structural elements are calculated for a planar surface; if these identical structural elements calculated in this way are placed—with identical orientation—on a curved surface of a lens, for example, then the structural elements are still, as already mentioned above, identical in their central area; however, in the transitional areas to the original lens surface on which the structural elements are placed, the structural elements have, due to curvature of the lens surface, a different shape, depending on their position on the lens surface, which, however, given the small size of the structural elements has no effect, or only a very small effect, on the resulting light pattern.

Furthermore, it is advantageous for all structural elements 110 to be identically oriented.

In a planar defined surface, this does not require any further explanations. In the case of curved surfaces (for example, a lens), the structural elements are identically arranged along axes through the surface, all of these axes running parallel to an axis of symmetry or to an optical axis of the surface and not normal to the surface normal).

This has advantages, especially for manufacturing, since this makes it simple to remove the optical structure and the tool to produce the structure, since no undercuts can form on the optical structure.

The inventive optical structure or a modified light pattern can optimally be produced if the spread function is a point spread function (PSF).

Furthermore, it is advantageous that the symmetry of a structural element depends on the symmetry of the spread function PSF. The structural element generally has the same symmetry class as the PSF. For example, if the PSF has horizontal mirror symmetry, then the structural element also has horizontal mirror symmetry.

Complete microstructuring of the lens surface represents a fundamental advantage for all application cases of the microstructure (e.g., xenon and LED projector systems, segmented light distribution, which are projected through lenses or other light-shaping bodies, . . . ).

The fact that the spread function is square represents a substantial improvement, especially for segmented light distributions, since otherwise without an inventive optical structure in this case the borders of square/rectangular segments would have to be displaced so that all gaps are closed, even in the vertices.

The invention claimed is:

1. An optical structure (100) for a motor vehicle headlight lighting device (1) that is configured to emit light forming a specified light pattern (LP1), wherein the optical structure (100) of the lighting device (1) is associated with the lighting device (1), or is part of it in such a way, that the optical structure (100) is transilluminated by essentially the entire luminous flux of the lighting device (1), and wherein:

the optical structure (100) consists of a number of optical structural elements (110) that have a light-scattering effect and that are designed in such a way that the unmodified light pattern (LP1) produced by the lighting device (1) is modified by the optical structure (100) into a specifiable modified light pattern (LP2), the optical structural elements (110) have a quadrilateral base area (202), meaning that the area (202) between the vertices (201) of a quadrilateral grid (200) is completely covered by the base area of exactly one optical structural element (110), the base area of each optical structural element (110) is formed by a rectangle or a square, and the structural elements (110) have, in their vertex areas, vertex area elevations (110*b*), each of which is formed by a lateral face of a pyramidal elevation (111*b*), and have, in their centers, a central elevation (110*a*).

2. The optical structure of claim 1, wherein the structural elements (110) have, in their centers, a central elevation (110*a*) with a circular base.

3. The optical structure of claim 1, wherein the modified light pattern (LP2) is formed by convolution of the unmodified light pattern (LP1) with a spread function (PSF), and in that the optical structure (100) is designed in such a way that the unmodified light pattern (LP1) is modified according to the spread function.

4. The optical structure of claim 3, wherein the optical structural elements (110) are designed in such a way that every structural element (110) modifies the light beam (LB1) passing through it according to the spread function (PSF) to produce a modified light beam (LB2).

5. The optical structure of claim 1, wherein the structural elements (110) are distributed over at least defined surface (111) of at least one optical element (5, 6).

6. The optical structure of claim 1, wherein the base of the central elevation (110*a*) extends to the four delimiting sides (203) of the quadrilateral base area (202).

7. The optical structure of claim 1, wherein the central elevation (110*a*) has a continuous course over its entire surface.

8. The optical structure of claim 1, wherein the central elevation (110*a*) has its maximum distance to the base area at the geometric center of its base area.

9. The optical structure of claim 1, wherein the central elevation (110*a*) has its minimum distance to the base area on its circumference.

10. The optical structure of claim 9, wherein the minimum distance of the circumference to the base area is equal to zero.

11. The optical structure of claim 1, wherein all structural elements (110) lying on a vertex (201) of the grid contribute to the pyramidal elevation (111*b*).

12. The optical structure of claim 11, wherein the apex (111*b*') of a pyramidal elevation (111*b*) lies exactly over a grid point (201) of the grid (200).

13. The optical structure of claim 1, wherein each of the optical structural elements (110) is designed to be symmetrical about its diagonal to have mirror symmetry.

14. The optical structure of claim 1, wherein in a section through a pyramidal elevation (111*b*) in a plane normal to the base area (202) along a diagonal (A-A) the vertex area elevations (110*b*) have an essentially linear slope.

15. The optical structure of claim 1, wherein in a section through a pyramidal elevation (111*b*) in a plane normal to the base area (202) along a delimiting side (203) the vertex area elevations (110*b*) have an essentially concave course.

16. The optical structure of claim 1, wherein the central elevation (110*a*) and the vertex area elevations (110*b*) continuously transition into one another.

17. The optical structure of claim 1, which is arranged on at least one boundary surface of an optical element that is designed in the form of a headlight lens (6) or in the form of a cover plate (6) of the lighting device (1).

18. The optical structure of claim 1, which is arranged on at least one surface of an optical element in the form of a lens (5) comprising a projector lens of the lighting device (1).

19. The optical structure of claim 18, which is arranged on the light exit side (5*a*) of the lens (5).

20. The optical structure of claim 1, wherein the structural elements (110) of the optical structure (100) are distributed over the entire at least one boundary surface (5*a*, 6*a*) of an optical element (5, 6).

21. The optical structure of claim 1, wherein all structural elements (110) are essentially identical.

22. The optical structure described of claim 1, wherein all structural elements (110) are identical with respect to a planar surface or an imaginary planar surface (111).

23. The optical structure of claim 1, wherein all structural elements (110) are identically oriented.

24. The optical structure of claim 1, wherein the spread function is a point spread function (PSF).

25. The optical structure of claim 1, wherein the dimension of a structural element (110), including a diameter (d) and/or a height (h) of the structural element (110), is greater than the wavelength of visible light.

26. The optical structure of claim 1, wherein the height (h) of the structural elements (110) lies in the micrometer range.

27. The optical structure of claim 26, wherein the height (h) of the structural elements (110) lies in the range 0.5-5 μm.

28. The optical structure of claim 27, wherein the height (h) of the structural elements (110) lies in the range 1-3 μm.

29. The optical structure of claim 28, wherein the height (h) of the structural elements (110) is about 2.7 μm.

30. The optical structure of claim 1, wherein the diameter (d) or a length of the structural elements (110) lies in the millimeter range.

31. The optical structure of claim 30, wherein the diameter (d) or a length of the structural elements (110) lies between 0.5-2 mm.

32. The optical structure of claim 31, wherein the diameter (d) or a length of the structural elements (110) is about 1 mm.

33. The optical structure of claim 1, wherein the defined surface (111) on which the structural elements (110) are distributed is subdivided into an imaginary regular grid structure (200), and the structural elements are arranged on the grid points (201) or between the grid points (201) of the grid structure (200).

34. The optical structure of claim 33, wherein exactly one structural element (110) is arranged on each grid point (201) or between the grid points (201) of the grid structure (200).

35. The optical structure of claim 33, wherein adjacent structural elements (110) change into one another, meaning that they are arranged to touch one another, or the structural elements (110) are isolated from one another, meaning that they are arranged not to touch one another.

36. The optical structure of claim 32, wherein adjacent grid points (201) are separated by about 0.5-2 mm.

37. The optical structure of claim 1, wherein the transition of the structural elements (110) to the defined surface (111) is continuous.

38. The optical structure of claim 37, wherein the transition of the structural elements (110) to the defined surface (111) is C2-continuous.

39. The optical structure of claim 1, for a lighting device (1) that is set up to project the light emitted from it in the form of a masked light pattern (LP1) comprising a low beam pattern, the masked light pattern (LP1) having a light/dark boundary (LD1), wherein the structural elements (110) or the spread function is/are designed in such a way to reduce the gradient of the light/dark boundary (LD1) of the unmodified light pattern (LP1) of the lighting device (1).

40. The optical structure of claim 1, for a lighting device (1) that is set up to project the light emitted from it in the form of a masked light pattern (LP1) comprising a low beam pattern, the masked light pattern having a light/dark boundary (LD1), wherein the structural elements (110) or the spread function is/are designed in such a way that part of the luminous flux of the lighting device (1) is projected into an area (LP2') above the light/dark boundary (LD1, LD2).

41. The optical structure of claim 40, wherein the deflected luminous flux lies in an area (LP2') between 1.5° and 4° above the HH line.

42. The optical structure of claim 40, which deflects about 1% of the luminous flux of the lighting device (1) into an area (LP2') above the light/dark boundary (LD1, LD2).

43. The optical structure of claim 1, for a lighting device (1) that is set up to project the light emitted from it in the form of individual light patterns (LS1) that are imaged in n rows and m columns, where n>1, m≥1 or n≥1, m>1, and that together form an entire light pattern (LP1) comprising a high beam pattern, wherein the structural elements (110) or the spread function is/are designed in such a way that at least part of the luminous flux of the lighting device (1) is deflected into the border areas, in each of which two individual light patterns border one another.

44. The optical structure of claim 43, wherein adjacent individual light patterns (LS1) of the unmodified light pattern (LP1) have a defined distance(s) (d1, d2) to one another.

45. The optical structure of claim 44, wherein all distances (d2) between adjacent individual light patterns (LS1) are identical in the vertical direction.

46. The optical structure of claim 44, wherein the individual light patterns (LS1) have a width and/or a height of about 1°.

47. The optical structure of claim 44, wherein the distance (d1, d2) between two adjacent individual light patterns (LS1) is less than or equal to 0.5° and greater than 0°.

48. The optical structure of claim 47, wherein the distance (d1, d2) between two adjacent individual light patterns (LS1) is less than or equal to 0.2°.

49. The optical structure of claim 47, wherein the distance (d1, d2) between two adjacent individual light patterns (LS1) lies between 0.05° and 0.15°.

50. The optical structure of claim 47, wherein the distance between two adjacent individual light patterns (LS1) is less than or equal to 0.1°.

51. The optical structure of claim 43, wherein the individual light patterns (LS1) of the unmodified light pattern (LP1), have a rectangular or square shape when projected onto a vertical plane.

52. The optical structure of claim 44, wherein all distances (d1) between adjacent individual light patterns (LS1) are identical in the horizontal direction.

53. The optical structure of claim 43, wherein the average luminous intensity in a gap between two individual light patterns (LS1) produced with the luminous flux that is intended for an individual light pattern corresponds to half the average luminous intensity in a bordering individual light pattern (LS1) of the modified light pattern.

54. The optical structure of claim 43, wherein it deflects part of that luminous flux that would, without an optical structure, produce exclusively one individual light pattern (LS1), into the gap areas that frame this individual light pattern (LS1) and that result from the spacing apart of the individual light patterns (LS1) from one another.

55. The optical structure of claim 54, wherein, starting from a viewed individual light pattern (LS1), the luminous intensity in a bordering gap decreases in the direction toward the adjacent individual light pattern (LS1), this decrease having a linear course.

56. The optical structure of claim 54, wherein the luminous intensity decreases to zero.

57. The optical structure of claim 54, wherein the luminous intensity in a gap directly bordering the edge of the viewed individual light pattern (LS1) essentially corresponds to the luminous intensity of the individual light pattern (LS1) of the modified light pattern at its edge or the average luminous intensity in the individual light pattern (LS1) of the modified light pattern.

58. The optical structure of claim 1, which is arranged and/or designed in such a way that essentially the entire luminous flux of the lighting device (1) impinges on the optical structure (100).

59. The optical structure of claim 1, which is arranged and/or designed in such a way that it is essentially homogeneously illuminated.

60. A lighting device comprising at least one optical structure (100) of claim 1.

61. The lighting device of claim 60, which is a projection system.

62. The lighting device of claim 61, which further comprises at least one light source (3), at least one reflector (2), and at least one lens (5) comprising a projector lens.

63. The lighting device of claim 62, wherein the at least one optical structure (100) is arranged on the lens (5) and/or on an additional cover plate or headlight lens.

64. The lighting device it of claim 60, which is a reflecting system.

65. The lighting device of claim 64, which further comprises at least one freeform reflector (2) and at least one light source (3) and at least one headlight lens (6) and/or at least one cover plate (6).

66. The lighting device of claim 65, wherein the at least one optical structure (100) is arranged on the at least one headlight lens (6) and/or the at least one cover plate (6) and/or an additional cover plate or headlight lens.

67. A vehicle headlight comprising at least one lighting device of claim 60.

* * * * *